US012098625B2

(12) United States Patent
McElhinney et al.

(10) Patent No.: US 12,098,625 B2
(45) Date of Patent: Sep. 24, 2024

(54) DOWNHOLE CORE PLUG APPARATUSES AND RELATED METHODS

(71) Applicants: Khalifa University of Science and Technology, Abu Dhabi (AE); Abu Dhabi National Oil Company, Abu Dhabi (AE)

(72) Inventors: James McElhinney, Abu Dhabi (AE); Ayesha Almarzooqi, Abu Dhabi (AE); Jorge Salgado Gomes, Abu Dhabi (AE)

(73) Assignees: Khalifa University of Science and Technology, Abu Dhabi (AE); Abu Dhabi National Oil Company, Abu Dhabi (AE)

( * ) Notice: Subject to any disclaimer, the term of this patent is extended or adjusted under 35 U.S.C. 154(b) by 0 days.

(21) Appl. No.: 17/640,900

(22) PCT Filed: Sep. 3, 2020

(86) PCT No.: PCT/IB2020/058218
§ 371 (c)(1),
(2) Date: Mar. 7, 2022

(87) PCT Pub. No.: WO2021/044344
PCT Pub. Date: Mar. 11, 2021

(65) Prior Publication Data

US 2022/0333453 A1 Oct. 20, 2022

Related U.S. Application Data

(60) Provisional application No. 62/896,290, filed on Sep. 5, 2019.

(51) Int. Cl.

| | |
|---|---|
| ***E21B 43/12*** | (2006.01) |
| ***E21B 23/03*** | (2006.01) |
| ***E21B 49/08*** | (2006.01) |

(52) U.S. Cl.
CPC ..... *E21B 43/122* (2013.01); *E21B 23/03* (2013.01); *E21B 49/08* (2013.01)

(58) Field of Classification Search
CPC ..... E21B 23/03; E21B 25/02; E21B 43/122; E21B 49/08; E21B 49/083
See application file for complete search history.

(56) References Cited

U.S. PATENT DOCUMENTS 4,449,593 A * 5/1984 Jageler ..... E21B 49/06 175/58
4,483,397 A 11/1984 Gray
(Continued)

FOREIGN PATENT DOCUMENTS

CN 105392366 A * 3/2016 ..... A01N 59/16
CN 114135279 A * 3/2022
(Continued)

OTHER PUBLICATIONS

Bailey, S.A. , et al., "Microbial Enhanced Oil Recovery: Diverse Successful Applications of Biotechnology in the Oil Field", SPE Asia Pacific Improved Oil Recovery Conference 9 (Society of Petroleum Engineers, Kuala Lumpur, Malaysia, 2001).
(Continued)

*Primary Examiner* — Jennifer H Gay
(74) *Attorney, Agent, or Firm* — Billion & Armitage

(57) ABSTRACT

Embodiments include a core plug holding apparatus including a tubular member configured to be inserted into a side pocket of a mandrel, the tubular member having an uphole end, a downhole end, and a core plug section located between the uphole end and the downhole end, wherein the core plug section is used for housing of one or more core plug samples and wherein tubular member includes one or more orifices formed in the core plug section. Embodiments include a method of sampling a well including deploying one or more core plug holding apparatuses into one or more
(Continued)

side pocket mandrels of a completion; holding the one or more core plug holding apparatuses in the one or more side pocket mandrels for an incubation period; and retrieving the one or more core plug holding apparatuses from the one or more side pocket mandrels after the passage of the incubation period.

19 Claims, 9 Drawing Sheets

(56) References Cited

U.S. PATENT DOCUMENTS

| | | | | |
|---|---|---|---|---|
| 4,501,323 | A * | 2/1985 | Lively | E21B 47/00 166/250.11 |
| 4,605,065 | A * | 8/1986 | Abercrombie | E21B 23/03 166/902 |
| 4,928,760 | A * | 5/1990 | Freitas | E21B 47/017 166/902 |
| 5,095,977 | A * | 3/1992 | Ford | G01N 17/046 422/53 |
| 5,209,129 | A | 5/1993 | Jaselskis et al. | |
| 6,227,302 | B1 * | 5/2001 | Pringle | E21B 43/123 166/387 |
| 8,684,110 | B2 * | 4/2014 | Reid, Jr. | E21B 25/10 175/239 |
| 9,051,804 | B2 * | 6/2015 | Reid, Jr. | E21B 25/10 |
| 9,874,063 | B2 * | 1/2018 | Arian | E21B 27/00 |
| 11,187,079 | B2 * | 11/2021 | Van Zuilekom | E21B 49/06 |
| 2004/0084186 | A1 | 5/2004 | Allison | |
| 2008/0066534 | A1 * | 3/2008 | Reid | E21B 49/06 73/152.13 |
| 2008/0236842 | A1 * | 10/2008 | Bhavsar | E21B 41/02 166/381 |
| 2009/0242197 | A1 * | 10/2009 | Hackworth | E21B 43/385 166/250.01 |
| 2013/0056201 | A1 * | 3/2013 | Chandler, Jr. | E21B 49/02 166/254.2 |
| 2013/0175049 | A1 * | 7/2013 | Reaux | E21B 23/03 166/381 |
| 2013/0233622 | A1 * | 9/2013 | Reid | E21B 25/10 175/58 |
| 2014/0209385 | A1 * | 7/2014 | Reid, Jr. | E21B 25/10 175/58 |
| 2014/0367086 | A1 * | 12/2014 | Arian | E21B 25/08 166/69 |
| 2016/0168952 | A1 | 6/2016 | Qu | |
| 2018/0371904 | A1 * | 12/2018 | Van Zuilekom | E21B 49/06 |
| 2021/0010366 | A1 * | 1/2021 | Chen | E21B 47/00 |
| 2021/0123344 | A1 * | 4/2021 | Westacott | E21B 25/10 |
| 2022/0074302 | A1 * | 3/2022 | Van Zuilekom | E21B 49/06 |
| 2022/0333453 | A1 * | 10/2022 | McElhinney | E21B 47/01 |

FOREIGN PATENT DOCUMENTS

| | | | |
|---|---|---|---|
| GB | 2036831 | A | 7/1980 |
| WO | 2005010362 | A2 | 2/2005 |

OTHER PUBLICATIONS

Behlülgil, K. , et al., "Bacteria for Improvement of Oil Recovery: A Laboratory Study", Energy Sources 24, 413-421, doi:10.1080/00908310252889915 (2002).

Bin, Lian , et al., "Effect of Microbial Weathering on Carbonate Rocks", Earth Science Frontiers, 2008, 15(6): 90-99.

Coyte, Katharine Z., et al., "Microbial competition in porous environments can select against rapid biofilm growth", Proceedings of the National Academy of Sciences 114, E161-E170, doi: 10.1073/pnas.1525228113 (2017).

Dong, Hailiang , "Mineral-microbe interactions: a review", Earth Sci. China 2010, 4(2): 127-147.

Eckert, Richard B., et al., "Advances in the application of molecular microbiological methods in the oil and gas Industry and links to microbiologically influenced corrosion", International Biodeterioration & Biodegradation (2016), http://dx.doi.org/10.1016/j.ibiod.2016.11.019.

Ezeuko, C. C. , et al., "Modelling biofilm-induced formation damage and biocide treatment in subsurface geosystems", Microbial Biotechnology, 6, 53-66, 2013.

Falkowski, Paul G., et al., "The Microbial Engines That Drive Earth's Biogeochemical Cycles", Science 320, 1034-1039, doi:10.1126/science.1153213 (2008).

Gibbons, Sean M., et al., "Microbial diversity—exploration of natural ecosystems and microbiomes", Curr Opin Genet Dev. Dec. 2015 ; 35: 66-72. doi:10.1016/j.gde.2015.10.003.

Gieg, Lisa M. , et al., "Methanogenesis, sulfate reduction and crude oil biodegradation in hot Alaskan oilfields", Environmental Microbiology 12, 3074-3086, doi:doi:10.1111/j.1462-2920.2010.02282.x (2010).

Lazar, I. , et al., "Microbial Enhanced Oil Recovery (MEOR)", Petroleum Science and Technology 25, 1353-1366, doi:10.1080/10916460701287714 (2007).

Le, Jian-Jun , et al., "Progress in pilot testing of microbial-enhanced oil recovery in the Daqing oilfield of north China". International Biodeterioration & Biodegradation 97 (2015) 188e194.

Panke-Buisse, Kevin , et al., "Selection on soil microbiomes reveals reproducible impacts on plant function", The Isme Journal 9, 980, doi:10.1038/ismej.2014. 196 (2014).

Safdel, Milad , et al., "Microbial enhanced oil recovery, a critical review on worldwide implemented field trials in different countries", Renewable and Sustainable Energy Reviews 74 (2017) 159-172.

Sivasankar, P. , et al., "Influence of bio-clogging induced formation damage on performance of microbial enhanced bil recovery processes", Fuel 236 (2019) 100-109.

Skovhusa, Torben Lund, et al., "Management and control of microbiologically influenced corrosion (MIC) in the bil and gas industry-Overview and a North Sea case study", Journal of Biotechnology 256 (Jul. 2017) 31-45.

International Search Report and Written Opinion for Application No. PCT/IB2020/058218 mailed on Feb. 8, 2021.

"Extended European Search Report Received mailed on Jul. 24, 2023", 15 Pages.

Examination Report for Application No. P6000378/2022 mailed on May 17, 2023, 8 pages.

* cited by examiner

DOWNHOLE CORE PLUG APPARATUSES AND RELATED METHODS

BACKGROUND

Microbes are ubiquitous and their activities have played a central role in shaping virtually all environments on our planet. These actions direct geochemical cycling of numerous elements, such as for example sulfur, oxygen, carbon and nitrogen, global water chemistries, oceanic weather, nutrient availability in soil, deposition and erosion of rocky minerals and early diagenesis. Within the context of porous media, microbial populations grow as surface-adhered biofilms that are governed by the flow of liquid phases, chemical diffusion (e.g., involving nutrient transport and signaling molecules), and migration of microbial cells.

The microbial communities (e.g., microbiomes) of oilfields can profoundly influence reservoir chemistries through the production of secreted macromolecules, and metabolites. These actions may have beneficial or detrimental impacts on upstream oil and gas operations. Pilot tertiary microbially-enhanced oil recovery programs in numerous geographically diverse formations have demonstrated the merits of exploiting beneficial microbial activities for oilfield production. Beneficial effects arise from processes—including biosurfactant, biosolvent and biopolymer production, methanogenesis, and in situ $CO_2$ production—that serve to mobilize hydrocarbons via reduced interfacial tension and increased miscibility, improved sweep efficiency, oil swelling, and reservoir pressurization. Microbes also drive acidification of carbonate matrices via organic acid production which can improve reservoir porosity by matrix dissolution. Reservoir flow can also be enhanced through microbial mobilization of paraffin deposits. Conversely, reservoir souring by sulfate reducing prokaryotes (SRPs), formation damage induced by microbial growth in pore throats, and microbially-induced corrosion of reservoir facilities, pose notable issues for upstream oil and gas operators.

While the importance of microbiological activities in oilfields is increasingly being recognized, monitoring the microbiological activities in oilfields remains an ongoing challenge. This is largely due to the high costs of obtaining uncontaminated biofilm samples that are representative of the reservoir. Indeed, the vast majority of downhole microbiome assessments are made by inferring data obtained from topside produced water planktonic populations in samples taken from producing wellheads. However, these planktonic communities differ from their sessile biofilm counterparts downhole and therefore are frequently not representative of the reservoir, or at least care must be taken when drawing conclusions from topside samples alone.

SUMMARY

According to one or more aspects of the invention, a core plug holding apparatus may include a tubular member configured to be inserted into a side pocket of a mandrel, the tubular member having an uphole end, a downhole end, and a core plug section located between the uphole end and the downhole end, wherein the core plug section is used for housing of one or more core plug samples and wherein tubular member includes one or more orifices formed in the core plug section.

According to one or more further aspects of the invention, a method of downhole sampling a production well may include one or more of the following steps: deploying one or more core plug holding apparatuses into one or more side pocket mandrels of a completion; holding the one or more core plug holding apparatuses in the one or more side pocket mandrels for an incubation period; and retrieving the one or more core plug holding apparatuses from the one or more side pocket mandrels after the passage of the incubation period.

According to one or more additional aspects of the invention, a gas lift system for use in a production well may include a production tubing extending into the production well and including one or more side pocket mandrels at one or more depths; and one or more core plug holding apparatuses, each of the one or more core plug holding apparatuses being installed in one or more of the side pocket mandrels.

DETAILED DESCRIPTION

Discussion

Figures 1, 2A, 2B:
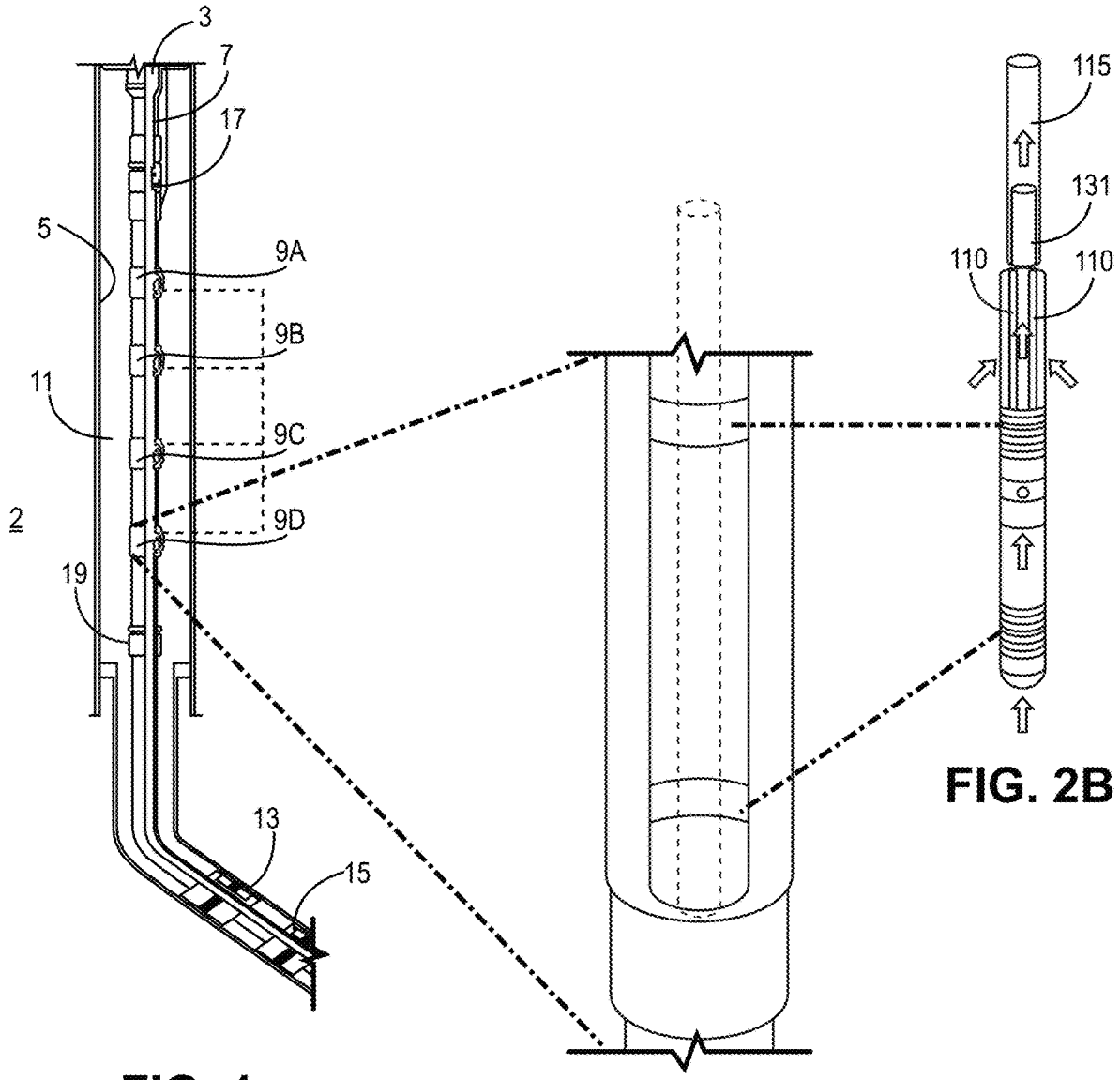
FIG. 1 is a schematic diagram of a system and method of microbiological, geochemical, corrosion, and/or geological sampling, wherein the schematic diagram depicts a cross-sectional view of at least a portion of a completion including a gas lift system to illustrate the positioning of one or more side pocket mandrels in which one or more core plug holding apparatuses may be deployed and/or retrieved using existing well infrastructure (e.g., wireline tools), according to one or more embodiments of the invention.
FIGS. 2A-2B are schematic diagrams depicting (A) an enlarged view of a side pocket mandrel to illustrate the positioning of a core plug holding apparatus (dashed lines) within said side pocket mandrel; and (B) an enlarged view of the core plug holding apparatus to illustrate fluid flow (arrows) and mounting of the core plug holder on a modified dummy gas lift valve base, according to one or more embodiments of the invention.

The sampling of oilfield microbiological communities is generally limited to obtaining planktonic community members at the wellheads of producing wells. These samples suffer from the need for filtration and concentration of sampled microbes which can bias community analyses. Another issue with collecting planktonic samples is the uncertainty surrounding their relevance to downhole processes, as the planktonic portion of microbes has been shown to be distinct from that of the biofilm portion. Therefore, planktonic community samples can only be used to infer microbiological activities in the field. Importantly, it is the biofilm community that holds the greatest information for monitoring microbial growth and microbial activities downhole since the biofilm is responsible for those microbiological activities that most influence the reservoir performance (e.g. souring, formation damage, biogas production, and/or hydrocarbonoclastic processes). Direct measure of these phenomena in the subsurface require solid materials to be brought to the surface, which invariably requires drilling operations. Drilling operations are disruptive to oilfield operations and therefore, expensive to carry out. Indeed, the costs of such activities increase as the target depth and core sizes increase. Additionally, the use of drilling fluids/muds are required. These can carry significant microbial populations which contaminate the sample and compromise downstream analyses.

The present invention overcomes the aforementioned challenges, among others, by providing a downhole core plug holding apparatus and related methods for microbiological, geochemical, corrosion, and/or geological sampling in oil producing wells. The downhole core plug holding apparatus may be deployed in and retrieved from oil producing wells using existing well infrastructure. For example, in some embodiments, the downhole core plug holding apparatus may have the dimensions of a gas lift valve. This permits one or more downhole core plug holding apparatuses to be installed in one or more side pocket mandrels. In addition, the one or more downhole core plug holding apparatuses may be retrieved from the one or more side pocket mandrels using wireline retrievable gas lift systems, among others, without the need for drilling operations. The absence of any drilling fluids and/or drilling muds reduces the risks of sample contamination during recovery of the one or more downhole core plug holding apparatuses. As production wells may include one or more side pocket mandrels at one or more depths, the downhole core plug holding apparatus may be installed at a plurality of depths such that depth-resolved comparisons may be made. The core plug holding apparatus may include core plug samples or rock coupons of real or representative reservoir rock for improved field microbiological monitoring, sampling, and analysis and thus avoids errors resulting from inferential conclusions concerning microbiological activities. These and other features of the downhole core plug holding apparatus permit operation at a fraction of the cost of conventional drilling approaches for obtaining downhole core and/or sidewall samples.

Additional advantages of the present invention include at least the following: (a) representative microbiological biofilm samples (in the context of the surrounding matrix), which are extremely useful for most oilfield microbiology applications, may be obtained and used to assess one or more of reservoir souring, formation damage, biocorrosion, microbially-enhanced oil recovery, etc.; (b) the presence of a plurality of side pocket mandrels at different depths in the well completion allows for comparison of microbiological and geochemical processes across different depths (and therefore different pressures and temperatures) while preserving in-situ water chemistry, thereby facilitating novel analyses to be made by enabling different scenarios of in situ testing; (c) the present invention considerably reduces the costs of downhole microbiological sampling, significantly simplifies the process of deploying and/or retrieving downhole samples, greatly reduces the amount of time during which a production well may be taken offline, and/or makes sampling available and accessible to a wider array of interested parties beyond commercial entities, including, for example and without limitation, universities and academic institutions; (d) the core plug holding apparatuses allows multiple sample types (e.g., panels of core plugs and/or coupons) with distinct fabrics to be utilized, wherein the ability to hold multiple samples and/or sample types at a time enables reproducibility and/or effect of fabric type to be tested; and (e) the core plug holding apparatuses are the first means for obtaining (e.g., truly representative) downhole microbially influenced corrosion (MIC) assessments (e.g., corrosion coupons) and/or samples, as conventional corrosion measurements downhole suffer from flaws and/or defects, like misinterpreting MIC risks (e.g., as MIC is a heterogeneous form of corrosion which is difficult to measure electrochemically and requires direct observations to be made on the sample via SEM, AFM, etc. to diagnose); among other things. The aforementioned advantages are therefore not limiting.

The core plug holding apparatus may be loaded with carbonate plugs or corrosion coupons for microbiological sampling/studies. Other types of core plug samples, such as rock coupons, etc. are discussed below. The carbonate plugs or corrosion coupons may be used to evaluate, among other things, one or more of reservoir damage, MEOR potential, souring, and microbially-influenced corrosion risks. In some embodiments, the loading of the core plug holding apparatus with naturally sourced and/or synthetic plugs may be used for petrochemical analyses. As the plugs are incubated downhole in truly representative reservoir conditions, which cannot be reproduced in the lab, and are retrieved at a fraction of the cost of downhole coring and without risk of contamination from drilling fluids, petrochemical analyses of field sites greatly benefit from use of the core plug holding apparatuses disclosed herein. These hyper realistic production fluid-saturated rocks may, among other analyses, serve in making assessments of the wettability properties of the rock within the reservoir and may be used for testing in core flooding studies which, for instance, may be focused on estimating the residual oil left in place (or recovery factor) evaluating sweep strategies, testing new polymer, water sources or adjusting gas injections) and so on.

FIG. 1 is a schematic diagram of a system and method of a completion including a gas lift system, according to one or more embodiments of the invention. More specifically, FIG. 1 is a schematic diagram of a cross-sectional view of a portion of the completion 1 including the gas lift system 3. The schematic diagram illustrates, among other things, the positioning of one or more side pocket mandrels in which a core plug holding apparatus may be deployed and/or retrieved using existing well infrastructure, such as a wireline-retrievable gas lift system, among others. As shown, the completion 1 may include a well (e.g., a wellbore) which is drilled into the earth to at least a depth intersecting an area of interest within a formation 2. The well may be considered a completion or completed upon inserting and setting casing 5 within the well using, for example, cement, although in other embodiments, the well may be uncased or only partially cased.

The gas lift system 3 may include a production tubing 7 for conveying production fluid (e.g., such as oil, gas, and/or other hydrocarbon-containing fluids) from the area of interest within the formation to the surface. The production tubing 7 may be run into the well and may include one or more side pocket mandrels 9A, 9B, 9C, 9D, wherein the one or more side pocket mandrels 9A, 9B, 9C, 9D may be spaced apart within the production tubing 7 (e.g., within an inner diameter of the production tubing 7) and may optionally be offset from a centerline of the production tubing 7. The one or more side pocket mandrels may be configured to house or include one or more core plug holding apparatuses 10A, 10B, 10C, and 10D at one or more depths, wherein the one or more core plug holding apparatuses are deployable and/or retrievable using the gas lift system 3, such as a wireline-retrievable gas lift system and/or tubing-retrievable gas lift system. An annulus 8 for conveying compressed gas from a valve system (not shown) may be formed between an outer diameter of the production tubing 7 and the inner diameter of the casing 5. One or more production packers 13,15 may be located at a downhole end of the production tubing 7 for forcing production fluid to flow from the area of interest in the formation 2 up through the production tubing 7 instead of the annulus 11. In some embodiments, the production tubing further includes a flow coupling 17 and a travel joint 19.

As will be described in more detail below, the one or more downhole core plug holding apparatuses 10A, 10B, 10C, 10D may have dimensions which are the same or similar to a gas lift valve such that the one or more core plug holding apparatuses 10A, 10B, 10C, 10D may be installed via, for example, wireline tools in the one or more side pocket mandrels 9A, 9B, 9C, 9D. In some embodiments, having dimensions which are the same and/or similar to gas lift valves enable the one or more core plug holding apparatuses 10A, 10B, 10C, 10D, to serve as a dummy gas lift valve (e.g., preventing cross-talk between the fluids in the annulus and the tubing of the producer) such that no modification needs to be made to the completion while said core plug holding apparatuses are installed (e.g., which is indicated in FIG. 2B). The one or more downhole core plug holding apparatuses 10A, 10B, 10C, 10D may include one or more core plug samples, or rock coupons, with properties representative of the rock and/or other mineral deposits present in, around, and/or near the region of interest of the formation. For example, in some embodiments, the core plug samples have a porosity, lithology, and permeability which is similar to or the same as the rock in the area or region of interest within the formation. Examples of core plug samples include without limitation carbonate plugs, corrosion coupons, rock coupons, natural plugs, synthetic plugs, among other types of materials. The one or more downhole core plug holding apparatuses 10A, 10B, 10C, 10D may be open at either end and/or on the sides so as to permit fluid (e.g., production fluid) to flow through and/or around the core plug samples for a predetermined incubation period. The incubation period may be any duration sufficient to permit geochemical and/or microbiological activity (e.g., biofilm formation) to occur near, around, and/or within the core plug samples. Following the incubation period, the one or more downhole core plug holding apparatuses 10A, 10B, 10C, 10D may be retrieved via, for example, wireline tools and collected at the surface.

The present disclosure may refer to core plug sample(s) utilized in, for example, one or more of microbiological, geochemical, corrosion, and/or geological sampling. The term is used as a generic term and includes all forms of sample types and/or materials for any type of sampling. The core plug samples may include any type of core plug sample disclosed above and/or below, including, for example and without limitation, generally coupons, such as rock coupons, corrosion coupons, and core plugs, and other types of materials, including porous materials, which may be used for sampling as described herein, and the like.

FIGS. 2A-2B is a schematic diagram of (2A) a side pocket mandrel including a downhole core plug holding apparatus and (2B) a downhole core plug holding apparatus, according to one or more embodiments of the invention. FIG. 2A illustrates the positioning of the downhole core plug holding apparatus within a side pocket mandrel. As shown, the downhole core plug holding apparatus may have a geometry and/or dimensions similar to, or the same as, a gas lift valve such that the downhole core plug holding apparatus may be installed in the side pocket mandrel. In some embodiments, the downhole core plug holding apparatus may be custom built with the same and/or similar dimensions of a gas lift valve, or mounted on an adapted or modified dummy gas lift valve base, forming an apparatus also with the same and/or similar dimensions of a gas lift valve. As shown in FIG. 2B, the downhole core plug holding apparatus may include one or more core plug samples (e.g., one or more one-inch core plug samples) which may optionally be stacked end-to-end within a tubular member. The tubular member may thus house the one or more core plug samples and may form a portion of, or may be mounted on, the dummy gas lift valve base, or it may be custom built. One or more longitudinal orifices or slots may be formed along a length of at least a portion of the tubular member housing the one or more core plug samples to allow lateral fluid flow to contact the one or more core plug samples within the tubular housing member. In embodiments in which a dummy gas lift valve is used, one or more orifices may be closed (e.g., to control fluid flow). In general, production fluid may flow from the bottom of the well and through, over, and/or around the one or more core plug samples. For example, in some embodiments, oil and/or water may pass through the one or more core plug samples. The arrows in FIG. 1C depict fluid flow according to one or more embodiments of the invention.

Figures 3A, 3B, 3C:
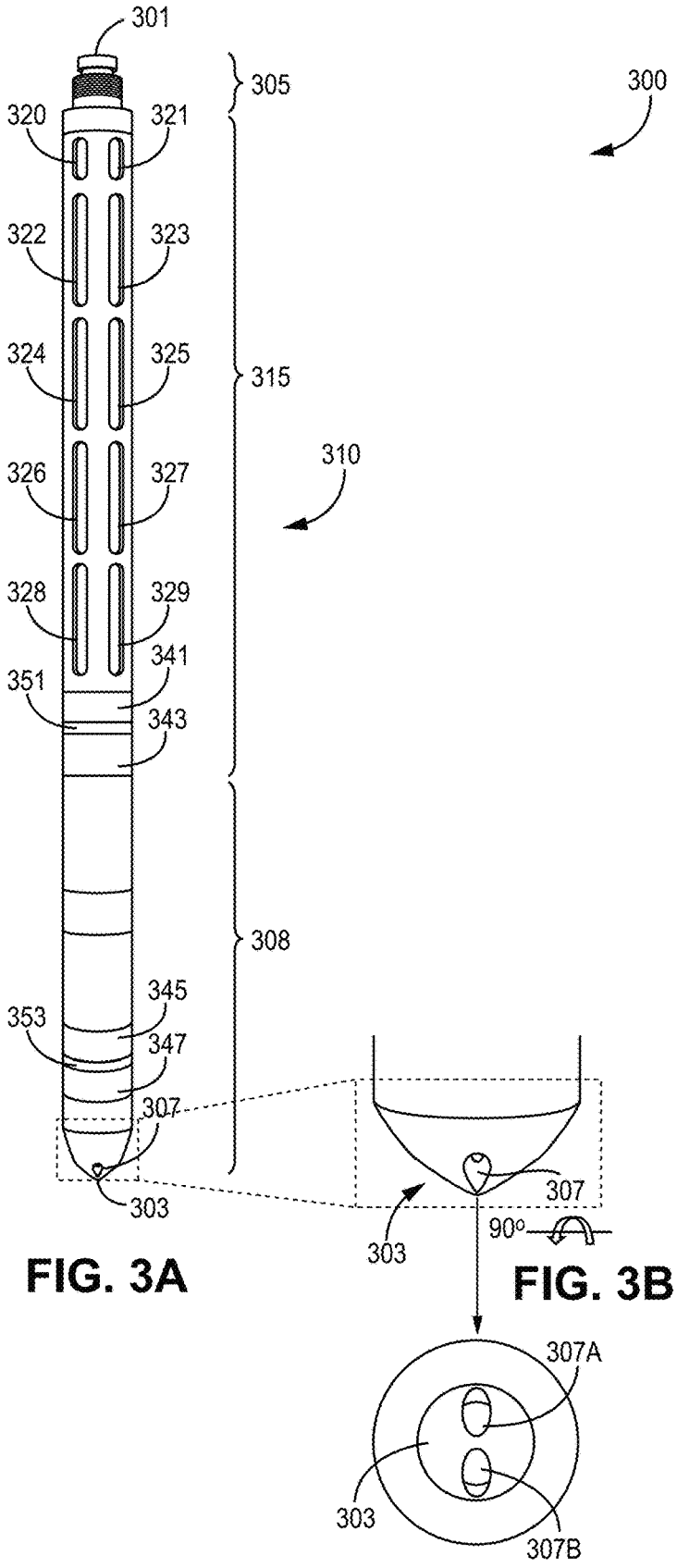
FIG. 3A is a schematic diagram of an exterior view of a core plug holding apparatus, according to one or more embodiments of the invention. As shown
FIG. 3B is a schematic diagram showing an enlarged schematic view of a downhole end of the core plug holding apparatus, according to one or more embodiments of the invention.
FIG. 3C is a schematic diagram showing another enlarged schematic view of the downhole end from FIG. 3B (rotated 90 degrees) of the core plug holding apparatus, according to one or more embodiments of the invention.

FIG. 3A is a schematic diagram of an exterior view of a core plug holding apparatus 300, according to one or more embodiments of the invention. In some embodiments, the core plug holding apparatus 300 is manufactured in corrosion-resistant high chromium-nickel Inconel alloy, although other corrosion-resistant materials may be utilized herein without departing from the scope of the present invention. As shown in FIG. 3A, the core plug holding apparatus 300 may include a tubular member 310. The tubular member 310 may have an uphole end 301 and a downhole end 303. A base 308 and a core plug section 315 (also referred to herein as a core plug receptable 315) may be located between the uphole end 301 and the downhole end 303. The base 308 and the core plug section 315 may be adjacent or at least proximal to each other and located between the uphole end 301 and the downhole end 303. In some embodiments, the core plug section includes 315 and 308.

The uphole end 301 may include a latch member 305. The latch member 305 may be used for deploying and/or retrieving the core plug holding apparatus 300. For example, in some embodiments, the latch member 305 may be deployable and/or retrievable using a wireline-retrievable gas lift system. In some embodiments, the latch member 305 is a wireline latch. The latch member 305 may be adapted for deployment and/or retrievable using other gas list systems and thus wireline-retrievable gas lift systems shall not be limiting. The latch member 305 may include one or more orifices, such as an inlet and/or an outlet orifice (not shown and discussed below), either or both of which may be in fluid communication with the core plug section 315. The downhole end 303 may include one or more orifices. For example, in some embodiments, the downhole end 303 includes one or more terminal intake orifices 307A, 307B.

The core plug section 315 may be configured to house one or more core plug samples (any of which disclosed herein may be used). As mentioned above, the core plug section 315 may be located between the uphole end 301 and the downhole end 303 of the tubular member 310. For example, as shown in FIG. 3A, in some embodiments, the core plug section 315 may be located more proximal to the uphole end 301 than the downhole end 305. In other embodiments, the core plug section 315 may be located about half-way between the uphole end 301 and the downhole end 303. In yet other embodiments, the core plug section 315 may be located more proximal to the downhole end 303 than the uphole end 301. In some embodiments, the core plug section 315 is mounted on a base 308. The base 308 may or may not include an adapted gas lift valve. In some embodiments, a gas lift valve, such as a dummy gas lift valve, is adapted and/or modified to form the core plug holding apparatus 300. For example, in some embodiments, the core plug section 315 is mounted on a gas lift valve base 308, such as a dummy gas lift valve base. The gas lift valve base 308 may be modified or adapted to the core plug section 315 to produce the core plug holding apparatus 300. For example, in some embodiments, the core plug section 315 is mounted on a modified/adapted gas lift valve base 308. In some embodiments, modified and/or adapting includes any of the features described herein, including closing one or more orifices, among other things. In some embodiments, the base 308 does not include a modified and/or adapted gas lift valve base (e.g., is custom-built).

The base 308, including a gas lift valve base, a modified/adapted gas lift valve base, a custom-built base, and/or a dummy gas lift valve base, may be located more proximal to the downhole end 303. In other embodiments, the base 308 may be located more proximal to the uphole end 301. In yet other embodiments, the base 308 may be located about half-way between the uphole end 301 and the downhole end 303. In some embodiments, the base 308 further includes one or more seals. The one or more seals may be located between the base 308 and the core plug section 315 and/or between the base 308 and the downhole end 303. In some embodiments, the one or more seals include one or more Teflon seals. In some embodiments, the one or more seals include one or more rubber or polymeric seals. In some embodiments, between the base 308 and the core plug section 315, a first rubber seal 341 and a second rubber seal 353 are located on opposing sides of, and optionally in direct contact with, a Teflon seal 351. The other side of the first rubber seal 341 may be coupled to the core plug section 315 (e.g., the side not in coupled to the Teflon seal 351). The other side of the second rubber seal 343 may be coupled to the base 308 (e.g., the side not coupled to the Teflon seal 351). In some embodiments, between the base 308 and the downhole end 303, a first rubber seal 345 and a second rubber seal 347 are located on opposing sides of, and optionally in direct contact with, a Teflon seal 353. The other side of the first rubber seal 345 may be coupled to the base 308 (e.g., the side not in coupled to the Teflon seal 351). The other side of the second rubber seal 347 may be coupled to the downhole end 303 (e.g., the side not coupled to the Teflon seal 351).

The core plug section 315 may or may not include one or more orifices 320, 321, 322, 323, 324, 325, 326, 327, 328, 329. The one or more orifices 320, 321, 322, 323, 324, 325, 326, 327, 328, 329 may be formed in the surface of the core plug section 315. In some embodiments, the one or more orifices 320, 321, 322, 323, 324, 325, 326, 327, 328, 329 include longitudinal slots of the same and/or similar shape and/or dimension. For example, in some embodiments, one or more orifices 320, 322, 324, 326, 328 may extend end to end along a length of the tubular member 310, and one or more orifices 321, 323, 325, 327, 329 may extend end to end along a length of the tubular member 310 adjacent to the one or more orifices 320, 322, 324, 326, 328, respectively. In some embodiments, one or more additional orifices (not shown) extend around an outer circumference of the core plug section 315. The one or more orifices 320, 321, 322, 323, 324, 325, 326, 327, 328, 329 may have the same or different shape and/or dimension. In some embodiments, the one or more orifices 320, 321, 322, 323, 324, 325, 326, 327, 328, 329 have a shape other than a longitudinal slot as shown. For example, the shapes of the one or more orifices 320, 321, 322, 323, 324, 325, 326, 327, 328, 329 may include circular, rectangular, triangular, polygonal, helical, etc. (See FIG. 6). In general, the shapes of the orifices are not particularly limiting provided said orifices permit or allow lateral fluid flow through the core plug section 315. In some embodiments, one or more of the one or more orifices 320, 321, 322, 323, 324, 325, 326, 327, 328, 329 are not present or excluded such that, for example, fluid flow is generally from the downhole end to the uphole end (e.g., optionally through the latch member 305). For example, in some embodiments, the core plug section 315 does not include any orifices.

FIGS. 3B-3C are schematic diagrams showing enlarged views of a downhole end of the core plug holding apparatus, according to one or more embodiments of the invention. As shown in FIGS. 3B-3C, the downhole end 303 may include one or more orifices 307A, 307B. The one or more orifices 307A, 307B may have any shape, such as the teardrop shape illustrated in FIGS. 3B-3C. The one or more orifices 307A, 307B may be formed into the downhole end 303 at an angle (e.g., angles between 0 and 90 degrees) to promote fluid flow through the one or more orifices 307A, 307B. In some embodiments, the one or more orifices 307A, 307B include one or more fluid intake orifices. For example, in some embodiments, the one or more fluid intake orifices introduce fluid flow—e.g., production fluid—into the base 308. The fluid may proceed to flow through the base 308 to the one or more core plug samples housed in the core plug section 315.

Figure 3D:
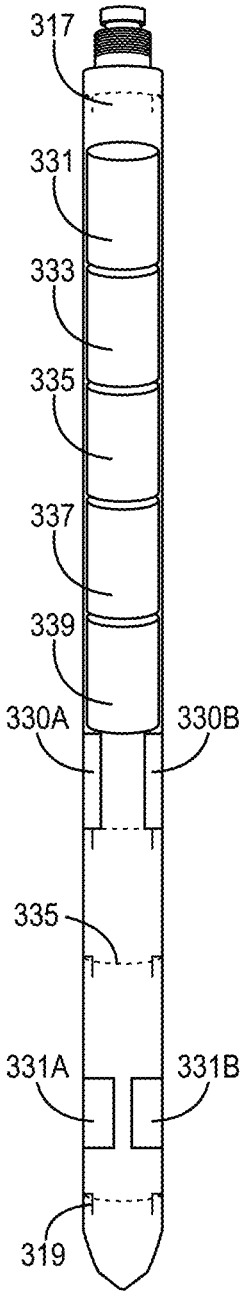
FIG. 3D is a schematic diagram of an interior view of a core plug holding apparatus, according to one or more embodiments of the invention.

FIG. 3D is a schematic diagram of an interior view of a core plug holding apparatus, according to one or more embodiments of the invention. The core plug holding apparatus 300 may include one or more threads 317, 319. For example, in some embodiments, the one or more threads 317 may be used for coupling the latch member 305 to the core plug section 315 of the core plug holding apparatus. In some embodiments, the one or more threads 317 are used for recovering—for example, by unscrewing the uphole end 301—the one or more core plug samples 331, 333, 335, 337, 339. In some embodiments, the one or more threads 319 may be used for coupling the downhole end 303 to the base 308 of the core plug holding apparatus.

As mentioned above, the core plug section 315 may be configured to house one or more core plug samples 331, 333, 335, 337, 339. In some embodiments, an inner diameter of the core plug section 305 includes one or more securing members 330A, 330B for securing, supporting, or holding the one or more core plug samples 331, 333, 335, 337, 339. In some embodiments, the inner diameter of the base 308 includes one or more securing members 330A, 330B for securing, supporting, or holding the one or more core plug samples 331, 333, 335, 337, 339. In some embodiments, the securing members 330A, 330B include one or more pin guides. The one or more pin guides 330A, 330B may be mounted, or immobilized, to the inner diameter of the base 308 and/or core plug section 315. In some embodiments, an inner diameter of the uphole end 301 of the tubular member 310 and/or of the core plug section 315 may include threading for coupling the latch member 305 to the uphole end 301. In some embodiments, an inner diameter of the downhole end 303 of the tubular member 310 and/or of the base 308 may include threading for coupling the downhole end 303 including one or more orifices 307A, 307B to the tubular member 310. In some embodiments, the tubular member 310 further includes one or more members 331A, 331B. In some embodiments, one or more of securing members 330A and 330B are excluded. This may be implemented to expand the capacity of core plug samples so as to permit inclusion of one or more additional core plug samples. In some embodiments, the one or more members 331A, 331B are securing members 331A, 331B for one or more core plug samples, including for example and without limitation core plug samples 331, 333, 335, 337, 339 and one or more additional core plug samples. In some embodiments, one or more securing members or one or more spacing members are provided between each of the one or more core plug samples (e.g., above and/or below each of the one or more core plug samples to provide spacing between each of the one or more core plug samples). In some embodiments, the one or more core plug samples include one or more donut and/or coin-shaped coupons, wherein the one or more donut and/or coin-shaped coupons may optionally be used as spacers between one or more core plug samples.

In some embodiments, the core plug holding apparatus does not include a ball valve or other similar valve. In some embodiments, the core plug holding apparatus does not include any threads in the core plug section 315. For example, in some embodiments, one or more threads have been removed from the core plug section 315. In some embodiments, the core plug holding apparatus includes gas lift valve segment boundaries 335. In some embodiments, the core plug section 315 does not include a spring and/or valve pin (e.g., to maximize and/or increase the core plug sample holding capacity of the core plug holding apparatuses and in particular of the core plug section, which may include core plug section 315 or both 315 and 308) In some embodiments, the base 308 does not include any annulus-connecting orifices—for example, to prevent ingress of annulus fluids.

Figure 3E:
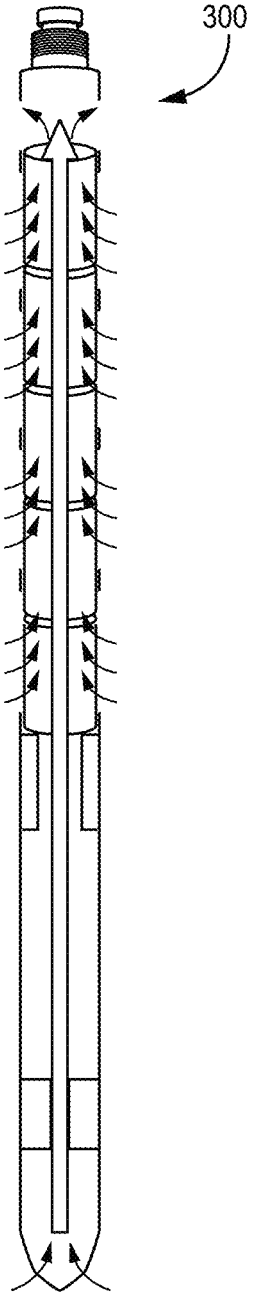
FIG. 3E is a schematic diagram of a core plug holding apparatus to illustrate fluid flow through said core plug holding apparatus (arrows), according to one or more embodiments of the invention.

FIG. 3E is a schematic diagram of a core plug holding apparatus to illustrate fluid flow through said core plug holding apparatus, according to one or more embodiments of the invention. Fluid flow may generally proceed from the downhole end 303 to the uphole end 301. As shown in FIG. 3E, a production fluid may be directed to the one or more core plug samples 331, 333, 335, 337, 339 via one or more orifices. In some embodiments, the production fluid enters the base 308 through the one or more orifices 307A, 307B and flows through the base 308 to the one or more core plug samples 331, 333, 335, 337, 339. In some embodiments, a production fluid is contacted with the one or more core plug samples 331, 333, 335, 337, 339 through the one or more orifices 320, 321, 322, 323, 324, 325, 326, 327, 328, 329 formed in the core plug section 315. In some embodiments, a production fluid exits through one or more orifices 320, 321 and/or through one or more orifices (not shown) formed in the uphole end 301. In some embodiments, the core plug section 315 does not include any orifices (not shown). For example, in some embodiments, the production fluid generally enters through the base 308 through the one or more orifices 307A, 307B and flows through the base 308 to the one or more core plug samples 331, 333, 335, 337, 339, to and through the latch member 305.

In some embodiments, a sampling system and method that makes use of existing well infrastructure (e.g., the housing of gas lift valves—GLV) is provided for deploying, holding, and retrieving one or more core plug samples of real reservoir rock for direct field microbiological monitoring and research programs. The tubular member may be characterized by the same or similar dimensions of a standard gas lift valve. The tubular member generally and in some embodiments the core plug section 315 may be configured to house one or more core plug samples, or rock coupons with the required rock properties (lithology, type of porosity, permeability, etc.). The nature and number of core plug samples may depend on the application and number of replicate samples desired. The device may be open at either end (e.g., may include one or more inlet and/or outlet orifices), and also on the sides, to permit fluid flow through and around the core plugs, which may be stacked end-to-end on top of each other.

Figure 4A:
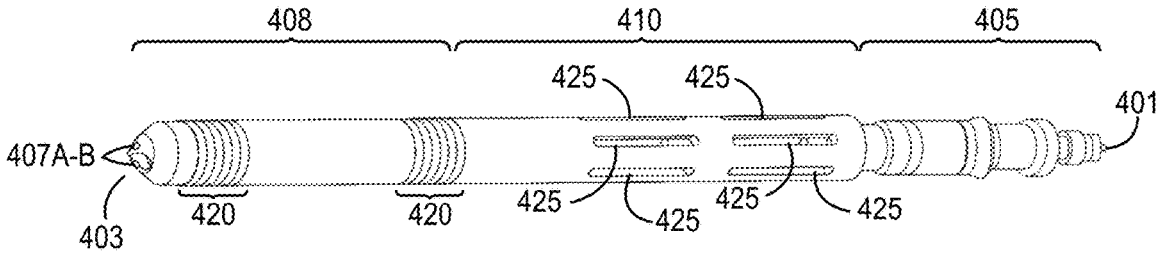
FIGS. 4A-4B provide (A) a schematic diagram of a core plug holding apparatus to illustrate various sections of the apparatus; and (B) a schematic diagram of the core plug holding apparatus where the core plug section and the latch member are separated to illustrate orifices in the core plug section and latch member that permit flow through, according to one or more embodiments of the invention.
Figure 4B:
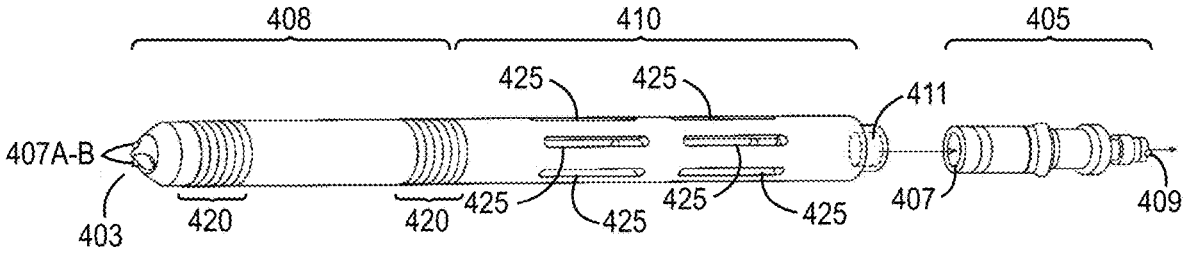

FIGS. 4A-4B provide (A) a schematic diagram of a core plug holding apparatus to illustrate various sections of the apparatus; and (B) a schematic diagram of the core plug holding apparatus where the core plug section and the latch member are separated to illustrate orifices in the core plug section and latch member that permit continuous fluid flow from the core plug receptable to and through the latch member, according to one or more embodiments of the invention. As shown in FIGS. 4A-4B, the core plug holding apparatus 400 includes a core plug receptacle (e.g., core plug section) 410 located between a base 408 and a latch member 405. In some embodiments, the latch member 405 is coupled to the core plug receptable 410 at an uphole end 401 and the base 408 is coupled to the core plug receptable 410 at a downhole end 403; however, other configurations, including the reverse configuration, are within the scope of the present invention. In some embodiments, the base 408 includes a flow bridge. In addition, the base 408 may include one or more seals 420.

The core plug holding apparatus 400 may include one or more orifices for directing a production fluid towards one or more core plug samples such that production fluid flows through and/or around (e.g., contacts) the one or more core plug samples before exiting the core plug holding apparatus 400. For example, the downhole end 403 of the core plug holding apparatus may include one or more orifices 407A, 407B for introducing production fluid into the inner diameter and/or interior of the core plug holding apparatus 400. Upon entering the core plug holding apparatus 400 through, for example, the one or more orifices 407A, 407B, production fluid may flow through an inner diameter of the base 408 to the core plug receptacle 410, where production fluid flows through and/or around the core plug samples (not shown) before exiting the core plug receptable 410 through an outlet orifice 411 located at an uphole end of the core plug receptable 410. The core plug holding apparatus 400 includes a modified latch member 405 including an orifice inlet 407 and an orifice outlet 409 which permits continuous fluid flow from the core plug receptacle 410 to the modified latch member 405, while maintaining the retrieval function of the latch member 405. The orifice inlet 407 may be coupled or mated with the outlet orifice 411 of the core plug receptable 410 such that the core plug receptable 410 and the latch member 405 are fluidly coupled. The connectors used for coupling the outlet orifice 411 and the inlet orifice 407 are not particularly limited and may include threading, male and female connectors, female and male connectors, respectively, among others. The length of the inner diameter of the inlet orifice 407 (and/or outlet orifice 411, depending on the type of connector used) is not particularly limited. For example, production fluid flowing from the core plug receptable 410 to the latch member 405 may flow through an orifice having a diameter of about 1 cm, although any diameter between 1 mm through 5 cm may be utilized herein without departing from the scope of the present invention. In some embodiments, one or more side pocket mandrels are present in injection wells. The core plug holding apparatus 400 accordingly may be utilized in one or more side pocket mandrels of an injection well to, for example, evaluate the influence of microbial/fines ingress into the reservoir.

The core plug receptable 410 may further include one or more orifices 425. The one or more orifices 425 may be utilized as inlet orifices, outlet orifices, or a combination thereof. The shape and/or dimensions of the one or more orifices 425 are not particularly limited and can be longitudinal slot-shaped as depicted in FIGS. 4A-4B, or may have other shapes and/or dimensions, either or both of which may be the same (e.g., orifices with the same dimensions and shape) or different (e.g., one or more orifices with a different shape and/or a different dimension). In some embodiments, the core plug receptable 410 may not include any orifices (not shown).

FIGS. 5A-5E provide various views of a core plug receptable of a core plug holding apparatus to illustrate the one or more ways in which the core plug receptable may be modified to increase cargo capacity and improve ease of use, among other things, according to one or more embodiments of the invention. More specifically, FIGS. 5A-5E provide (A) a schematic of an external view of a portion of a core plug holding apparatus; (B) a schematic diagram of a portion of a core plug holding apparatus; (C) a schematic diagram of an internal view of a portion of a core plug holding apparatus; (D) a schematic diagram of an internal view of a portion of another core plug holding apparatus; and (E) a schematic diagram of an external view of a portion of a core plug holding apparatus; according to one or more embodiments of the invention.

Figure 5A:
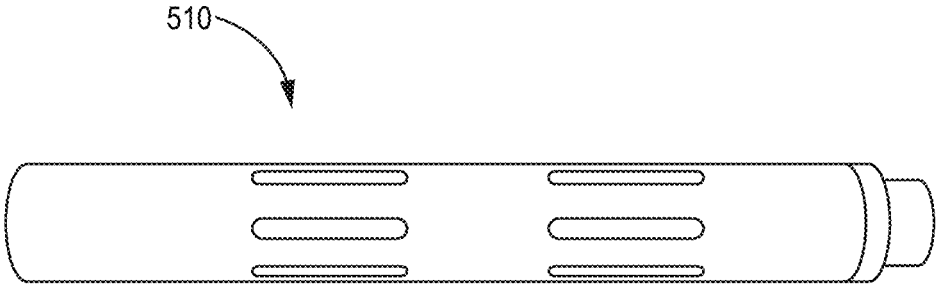
FIGS. 5A-5E provide (A) a schematic of an external view of a portion of a core plug holding apparatus; (B) a schematic diagram of a portion of a core plug holding apparatus; (C) a schematic diagram of an internal view of a portion of a core plug holding apparatus; (D) a schematic diagram of an internal view of a portion of another core plug holding apparatus; and (E) a schematic diagram of an external view of a portion of a core plug holding apparatus; according to one or more embodiments of the invention.
Figure 5B:
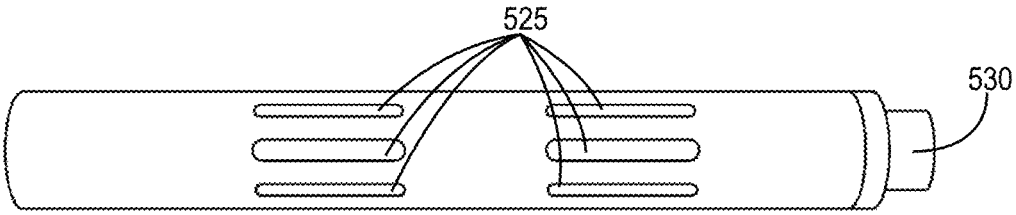
Figure 5C:
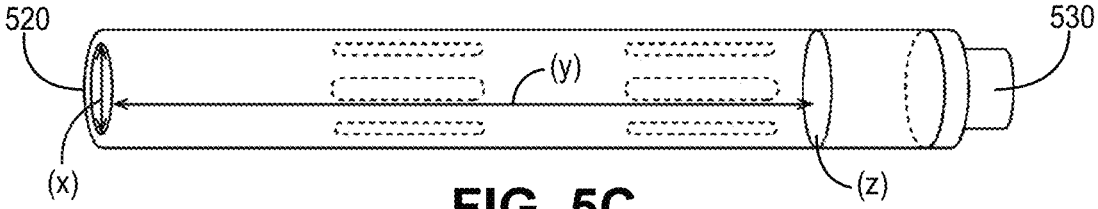
Figure 5D:
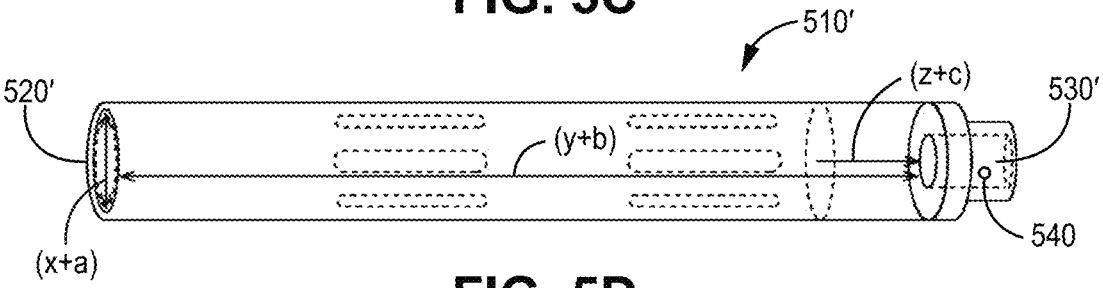

FIGS. 5A-5B are schematic diagrams of a portion of core plug holding apparatus, specifically a core plug receptacle, according to one or more embodiments of the invention. The core plug receptable 510 includes one or more orifices 525 and a latch member connector 530 at an uphole end of the core plug receptacle 510. The latch member connector 530 may and/or may not include an inlet or an outlet orifice. FIG. 5C is a schematic diagram of an interior view of an unmodified core plug receptacle 510 having an inner diameter of length, x; an internal cavity of length, y; and an uphole end of the internal cavity at position, z. FIG. 5D is a schematic diagram of an interior view of a modified core plug receptable 510'.

Figure 5E:
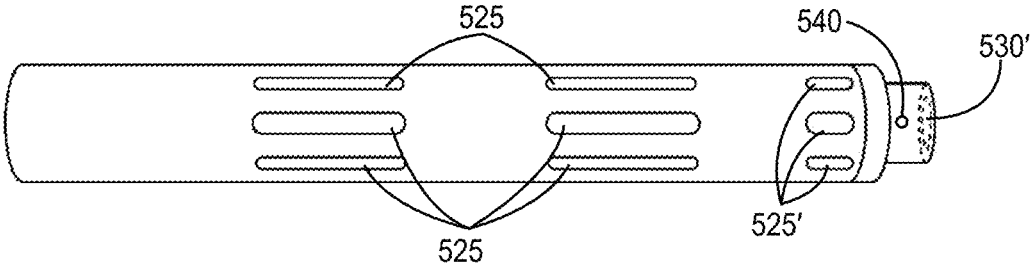

As shown in FIG. 5D, the core plug receptable 510 can be modified to the core plug receptable 510' by introducing one or more of the following changes: increasing the inner diameter of length x to a diameter of x+a, where a may be about 10 mm or less (e.g., by about 2 mm); increasing the internal cavity of lengthy to a length of y+b, where b may be about 10 inches or less (e.g., by about 2 inches); and/or extending the uphole end of the internal cavity at position z to a position z+c, where c may be 10 inches or less. In some embodiments, the lengthening of the inner diameter x enables better clearance for probes and/or improves fluid flow through. In some embodiments, lengthening the internal cavity of the receptable is achieved by shifting the internal face z. This may be performed to maximize cargo capacity. In some embodiments, an orifice may be formed in the latch member connector 530 to obtain a modified latch member connector 530'. The latch member connector/outlet orifice 530' may be used for permitting continuous fluid flow from the core plug receptable 510' to and through the latch member (not shown). In some embodiments, lengthening the internal cavity of the receptable provides space for one or more additional orifices 525'. In addition, new holes 540 may be drilled or formed in the latch member 530'. FIG. 5E illustrates the new holes 540 and orifices 525'.

In some embodiments, for example, modifications may be made to increase cargo capacity and ease of use. More specifically, the modifications may include an expansion (e.g., of approximately 2 mm) of the inner diameter of the inlet orifice 520 in the core plug receptacle section 510' to facilitate loading and unloading of core plug samples in the core plug holding apparatus. A shifting of the internal face z (e.g., by approximately 2 in) in the core plug receptacle section may provide space for additional one-inch length plugs (e.g., one or more additional one-inch core plug samples, such as 2 additional core plug samples). In addition, alternative or additional external slots/holes (e.g., orifices) arrangements may also be possible with extending the length of the core plug receptable and/or internal cavity thereof. The terminal hole (e.g., outlet orifice 530' in the core plug receptacle section 510') may be formed in the latch member connector 530. However, in some embodiments, an examination of the GLV housing in a standard ex-service side pocket mandrel may indicate that external slots along the length of the receptacle section may not significantly influence flow through the core plug samples within the apparatus and may be removed. In some such embodiments, fluid flow may be optimized by increasing the diameter of the inlet orifice in the nose of the base (not shown) (e.g., flow bridge section) and outlet orifices in the receptacle and latch member sections. In some embodiments, the placement of the seals may be adjusted to ensure the best fit to the orifices (linking the annulus to the interior of the completion) in the side pocket mandrels, among other things.

Figure 6:
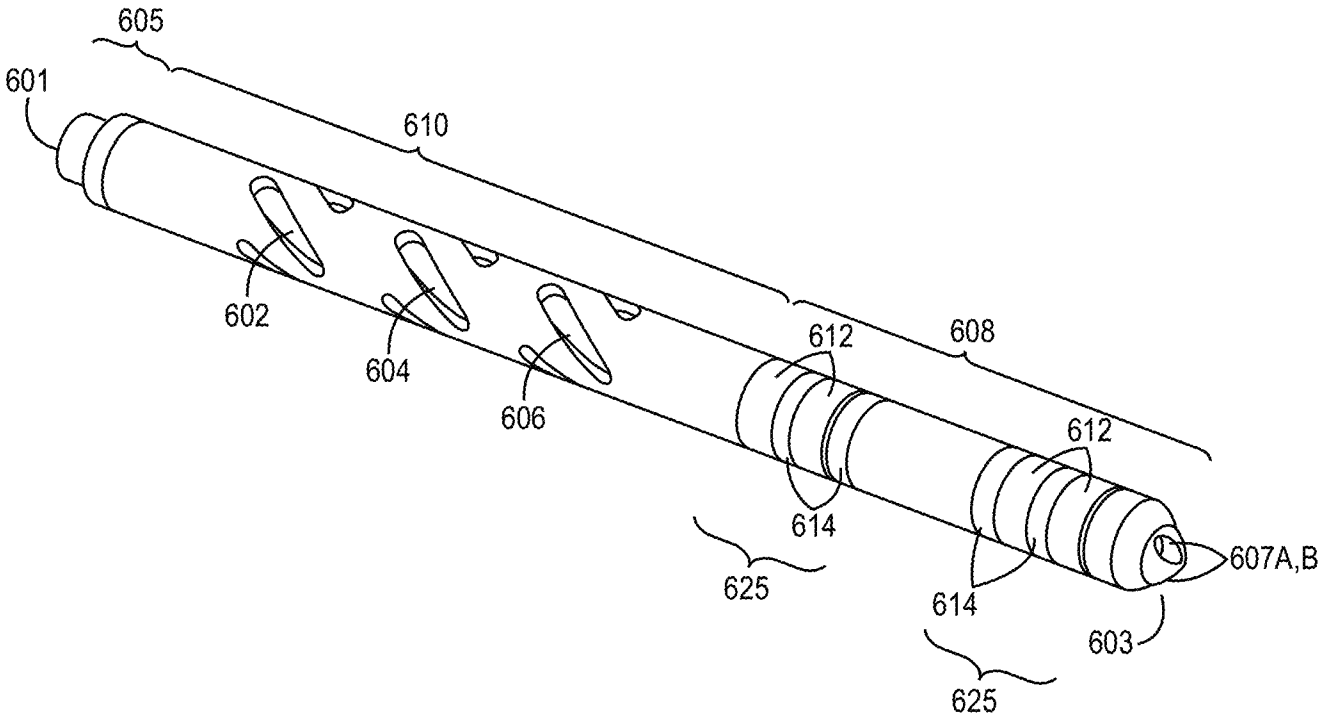
FIG. 6 is a schematic diagram of a core plug holding apparatus, according to one or more embodiments of the invention.

FIG. 6 is a schematic diagram of a core plug holding apparatus with helical-shaped orifices formed in the core plug receptacle, according to one or more embodiments of the invention. As shown in FIG. 6, the core plug holding apparatus 600 includes one or more helical orifices 602, 604, 606 arranged around an outer perimeter of the core plug receptable 610. The core plug receptable is coupled to and located between the latch member 605 and base 608. The base 608 includes seals 625, wherein the seals may include one or more spacers 612 and/or one or more gas lift valve seals 614. The downhole end 603 may include one or more orifices 607A, 607B, and the uphole end 601 may include an outlet orifice (not shown) formed in the latch member 605.

Figure 7A:
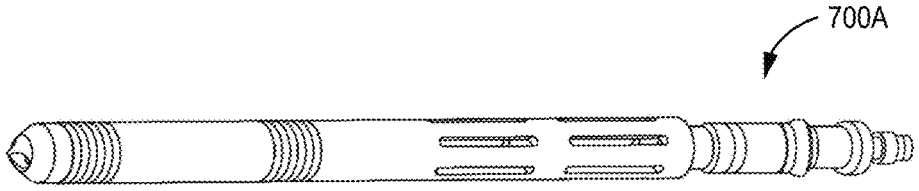
FIGS. 7A-7B are (A) a schematic diagram of a core plug holding apparatus and (B) a schematic diagram of a transport canister for said core plug holding apparatus, according to one or more embodiments of the invention.
Figure 7B:
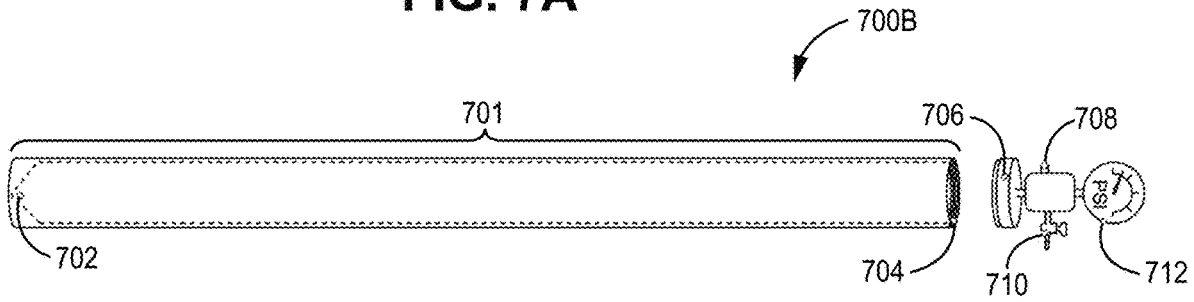

FIGS. 7A-7B are (A) a schematic diagram of a core plug holding apparatus and (B) a schematic diagram of a transport canister for said core plug holding apparatus, according to one or more embodiments of the invention. Any of the core plug holding apparatuses disclosed herein may be utilized as the core plug holding apparatus 700A. The transport canister 700B may be adapted and/or modified to fit the corresponding core plug holding apparatuses. The orientation of the core plug holding apparatus 700A is the orientation in which it will be introduced and stored in the transport canister 700B. The canister body 701 may be manufactured in, but not limited to, stainless steel. Internal dimensions of the canister body 701 are indicated by the dashed line. A conical internal base 702 may be configured to limit movement of the core plug holding apparatus during transport ensuring that downstream analyses are not adversely affected by impacts during transportation. An internal thread 704 for connecting the lid 706 is used to prevent leaking of fluids and gas (and preventing oxygen ingress) during transport. The lid 706 (shown disassembled here) will consist of a gas port 710 for purging the container with nitrogen (or anaerobic mixed gas) prior to retrieval of the core plug holding apparatus from the field site. The lid 706 may also contain a safety valve 708 to prevent over pressurizing the canister body 701 and a pressure gauge 712 for maintaining desired pressures when needed. For microbiological analyses, the canister 700B may be transported on ice, although in other embodiments of the canister 700B may include a jacket or annulus for ice or alternative feature to facilitate chilling the core plug holding apparatus (post retrieval from the field site) in order to preserve the microbial community when transported to the lab.

In some embodiments, a canister 700B may include a stainless-steel screw top cylindrical container 701 that is designed to be airtight when closed. The container screw top may include a gas valve 710 to enable nitrogen purging and thereby prevent oxygen ingress, which is advantageous for studies of the living microorganisms downhole (e.g., because oxygen is toxic for obligate anaerobic microbes, which typically dominate in hydrocarbon reservoir communities downhole).

Figure 8:
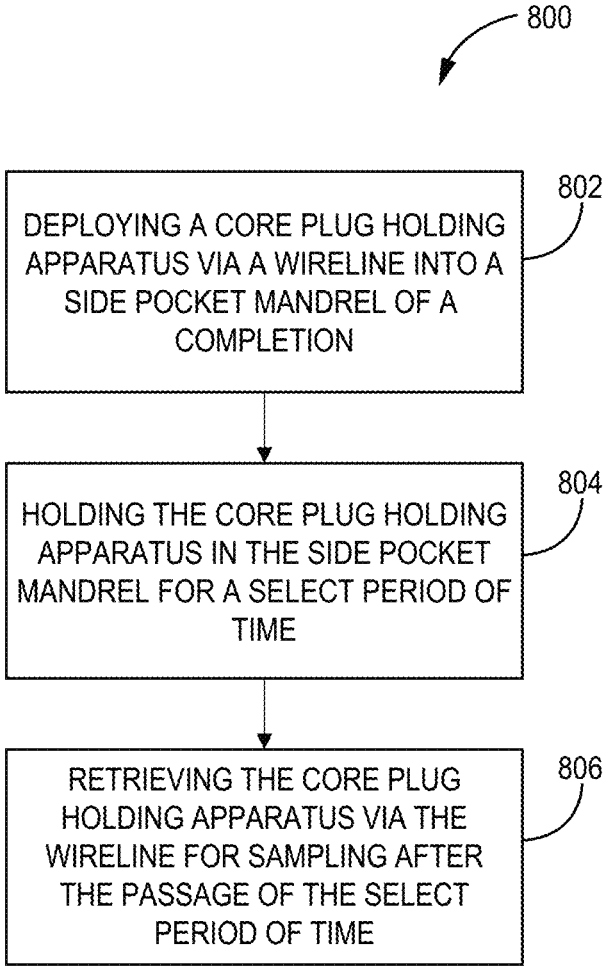
FIG. 8 is a flowchart of a method of sampling a production well, according to one or more embodiments of the invention.

FIG. 8 is a flowchart of a method of sampling a production well, according to one or more embodiments of the invention. As shown in FIG. 8, the method 800 of sampling a production well may include one or more of the following steps: deploying 802 one or more core plug holding apparatuses into one or more side pocket mandrels of a completion; holding 804 the one or more core plug holding apparatuses in the one or more side pocket mandrels for an incubation period; and retrieving 806 the one or more core plug holding apparatuses from the one or more side pocket mandrels after the passage of the incubation period. In some embodiments, one or more core plug holding apparatuses are deployed using an artificial lift, such as a gas lift system. In some embodiments, for example, one or more core plug holding apparatuses are deployed using a wireline-retrievable gas lift system (e.g., wireline tools). In other embodiments, one or more core plug holding apparatuses are deployed using a tubing-retrievable gas lift system. The incubation period is not particularly limited and may include any duration. The incubation period may include a duration sufficient to promote the microbiological, geochemical, and/or geological activity on the one or more core plug samples. Following the incubation period, the one or more core plug holding apparatuses may be retrieved via the system used to deploy said core plug holding apparatuses including, for example and without limitation, wireline-retrievable gas lift systems (e.g., via wireline tools), etc.

In some embodiments, a core plug holding apparatus may be loaded with one or more stacked 1-inch diameter core plug samples and then lowered or deployed (e.g., via wireline tools) and installed into at least one side-pocket mandrel of the completion. The at least one side pocket mandrel may be a location where a dummy gas lift valve is conventionally installed. The core plug holding apparatus may be held in the side pocket mandrel for an any duration, including predetermined lengths of time (to allow for the desired geochemical or microbiological processes of interest to occur around and within the porous network of the rock coupons (e.g., core plug samples). Following a pre-determined incubation period, the device can be retrieved using, for example, a gas lift valve recovery standard operating procedure. The core plug samples, or more generally the core plug holding apparatus, may then be collected at surface. By utilizing redundant GLV housing in this way, the generation and collection of downhole geological and microbiological samples from established hydrocarbon reservoirs is achieved in a manner that costs a fraction of that required to obtain downhole core or sidewall samples by current state of the art drilling approaches, especially being that side pocket mandrels can be found at depths of several thousand meters, thereby enabling access to samples representing conditions at considerable depths. Additionally, given that completions typically house several side pocket mandrels, the device may be held at a single or multiple depths of interest (as desired) enabling depth-resolved comparisons to be made. Furthermore, the absence of drilling fluids or muds would considerably reduce risks of contamination during sample recovery.

In some embodiments, a core plug holding apparatus may include a tubular member configured to be inserted into a side pocket of a mandrel, the tubular member having an uphole end, a downhole end, and a core plug section located between the uphole end and the downhole end, wherein the core plug section is used for housing of one or more core plug samples and wherein tubular member includes one or more orifices formed in the core plug section, wherein the core plug samples are optionally used for one or more of microbiological sampling, geochemical sampling, corrosion sampling, and geological sampling.

In some embodiments, the one or more orifices formed in the core plug section allow a production fluid to contact the one or more core plug samples within the core plug section of the tubular member.

In some embodiments, the one or more orifices include one or more longitudinal slots and/or one or more helically-shaped slots.

In some embodiments, the one or more orifices are positioned adjacent to each other in one or more dimensions.

In some embodiments, the core plug section is configured to house a plurality of core plug samples stacked end to end.

In some embodiments, the core plug section is located more proximal to the uphole end than to the downhole end.

In some embodiments, one or more securing members are disposed within an inner diameter of the tubular member for securing the one or more core plug samples.

In some embodiments, the one or more core plug samples include corrosion coupons.

In some embodiments, the core plug samples include a porous material and wherein the porous material includes a rock material representative of a particular region of the formation.

In some embodiments, the core plug holding apparatus further includes a latch member at the uphole end of the tubular member.

In some embodiments, the latch member is compatible with a wireline-retrievable gas lift system.

In some embodiments, the latch member includes an inlet orifice and an outlet orifice.

In some embodiments, the core plug holding apparatus further includes one or more intake orifices at the downhole end.

In some embodiments, a method of sampling a production well may include deploying one or more core plug holding apparatuses of claim 1 into one or more side pocket mandrels of a completion; holding the one or more core plug holding apparatuses in the one or more side pocket mandrels for an incubation period; and retrieving the one or more core plug holding apparatuses from the one or more side pocket mandrels after the passage of the incubation period.

In some embodiments, the one or more core plug holding apparatuses are deployed and/or retrieved via a wireline of a wireline-retrievable gas lift system.

In some embodiments, the one or more side pocket mandrels are positioned at one or more depths of the completion.

In some embodiments, the one or more core plug samples include microbial biomass or a biofilm.

In some embodiments, the method further includes adjusting at least one parameter of the production well in response to an analysis of the one or more core plug samples.

In some embodiments, a gas lift system for use in a production well and/or an injection well may include a production tubing extending into the production well and including one or more side pocket mandrels at one or more depths; and one or more core plug holding apparatuses of claim 1, each of the one or more core plug holding apparatuses being installed in one or more of the side pocket mandrels. In some embodiments, the gas lift system includes a wireline-retrievable gas lift system.

Any aspects of any embodiment and/or example may be utilized across any and all embodiments of the present invention.

EXAMPLE

Downhole Oilfield Device

Figure 9A:
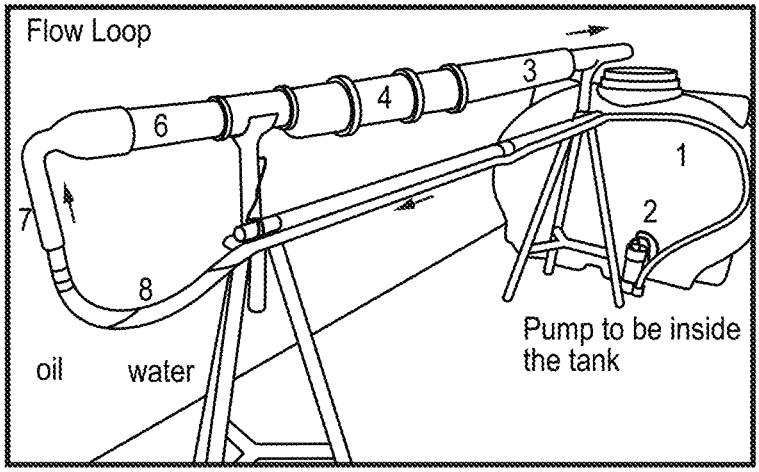
FIGS. 9A-9B are schematics of a customized flow loop system used for testing a core plug holding apparatus, according to one or more embodiments of the invention.
Figure 9B:
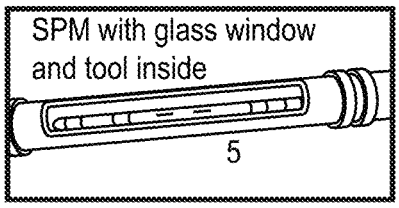

A downhole oilfield sampler was fabricated and evaluated using a flow loop system. The downhole oilfield sampler that was fabricated was similar in design to the downhole oilfield sampler presented in FIGS. 4A-4B. The flow loop system is presented in FIGS. 9A-9B, which provide (A) an image of the flow loop system and (B) an enlarged image showing a window custom built into the side pocket mandrel for observation purposes (e.g., to examine flow), among other things. The downhole oilfield sampler is shown in FIG. 9B and was installed using wireline tools. The flow loop system was created to test the installation, performance, and flow through the device. The loop was built using a modified ex-service completion tubing complete with a side pocket mandrel This involved refurbishing and modifying the side pocket mandrel to enable viewing of the device during flow loop experiments.

The flow loop system 900 includes a tank 1 (which is renumbered here to 901), a submersible pump 2 (which is renumbered here to 902), a 3½ inch tubing 3 (which is renumbered here to 903), a side pocket mandrel 4 (which is renumbered here to 904), a window 5 (which is renumbered here to 905), a pup joint 6 (which is renumbered here to 906), a flow diverter 7 (which is renumbered here to 907), and a hose 8 (which is renumbered here to 908). As shown in FIGS. 9A-9B, the flow loop system 900 included a tank 901 containing oil and brine. The volumetric capacity of the tank 901 was about 1,100 liters. A submersible pump 902 was fluidly connected to the tank 901. Although shown outside the tank 901 in FIG. 9A, the submersible pump 902 (1300 bpd) was immersed inside the tank 901 during testing operations. A 3½ inch tubing 903 with a side pocket mandrel 904, which included a window 905 as mentioned above, was fluidly connected to the tank 901 and the submersible pump 902 via a hose 908 which was used for returning fluid (e.g., production fluid) back to the tank 901. A flow diverter (reducer) 907 was installed between a pup joint 906 and the hose 908. The pup joint was fluidly connected to the tubing 903 and side pocket mandrel 904 and the flow diverter (reducer) 907. FIG. 9B shows the downhole oilfield apparatus installed in the side pocket mandrel and the window 905 used for observation purposes, among other things.

Initial flow loop tests in single phase (water) and dual phase (~25% oil in water) were carried out at a flow rate of about 1,300 barrels per day (bpd) with tracer chemicals to evaluate performance and flow through the device. Samples were collected over a range of pore volumes of the loop and analysed for tracer quantitation. In addition, initial fluid dynamics simulations were carried out to evaluate backpressure and flow through the device in field settings. It was observed that approximately 40 bpd will flow through the device and backpressure will be negligible for the device itself.

What is claimed is:

1. A downhole formation assessment and sampling tool comprising:

a tubular member configured to be installed into one of a plurality of side pocket mandrels; the tubular member having an uphole end, a downhole end; and a payload housing section positioned between the uphole and downhole ends, the payload housing section is configured to expose a payload, via one or more orifices in the payload housing section, to reservoir fluids from an area of interest in a hydrocarbon reservoir under reservoir conditions for one or more of microbiological monitoring, microbiological sampling, and/or geochemical sampling, wherein the downhole formation assessment and sampling tool is configured to serve as a dummy gas lift valve.

2. The downhole formation assessment and sampling tool of claim 1, wherein the downhole formation assessment and sampling tool is configured for annular flow of reservoir fluids around the payload.

3. The downhole formation assessment and sampling tool of claim 1, wherein the payload housing section is configured to house a plurality of payloads stacked end to end.

4. The downhole formation assessment and sampling tool of claim 1, wherein one or more securing members are housed within the payload housing section for securing the payload.

5. The downhole formation assessment and sampling tool of claim 1, further comprising a payload housed in the payload housing section, wherein the payload includes a porous material, further wherein the payload is representative of a particular region of the formation or has a desired characteristic.

6. The downhole formation assessment and sampling tool of claim 1, further including a latch member at the uphole end of the tubular member.

7. A core plug holding apparatus comprising:

a tubular member configured to be inserted into a side pocket of a mandrel, the tubular member having an uphole end, a downhole end, and a core plug section located between the uphole end and the downhole end, wherein the core plug section is used for housing of one or more core plug samples and wherein tubular member includes one or more orifices formed in the core plug section, wherein the core plug samples are used for one or more of microbiological sampling, geochemical sampling, corrosion sampling, and geological sampling, wherein the one or more orifices formed in the core plug section allow a production fluid to contact the one or more core plug samples within the core plug section of the tubular member.

8. The core plug holding apparatus of claim 7, wherein the core plug section is located more proximal to the uphole end than to the downhole end.

9. The core plug holding apparatus of claim 7, wherein the one or more core plug samples include corrosion coupons.

10. The core plug holding apparatus of claim 7, wherein a latch member is compatible with a wireline-retrievable gas lift system.

11. The core plug holding apparatus according to claim 10, wherein the latch member includes an inlet orifice and an outlet orifice.

12. The core plug holding apparatus of claim 7, further including one or more intake orifices at the downhole end.

13. A method of sampling a production well comprising:

deploying one or more core plug holding apparatuses into one or more side pocket mandrels of a completion, wherein each core plug holding apparatuses comprising:

a tubular member configured to be inserted into a side pocket of a mandrel, the tubular member having an uphole end, a downhole end, and a core plug section located between the uphole end and the downhole end, wherein the core plug section is used for housing of one or more core plug samples and wherein tubular member includes one or more open orifices formed in the core plug section, wherein the core plug samples are used for one or more of microbiological sampling, geochemical sampling, corrosion sampling, and geological sampling;

holding the one or more core plug holding apparatuses in the one or more side pocket mandrels for an incubation period; and retrieving the one or more core plug holding apparatuses from the one or more side pocket mandrels after the passage of the incubation period.

14. The method according to claim 13, wherein the one or more core plug holding apparatuses are deployed and/or retrieved via a wireline of a wireline-retrievable gas lift system.

15. The method of claim 13, wherein the one or more side pocket mandrels are positioned at one or more depths of the completion.

16. The method of claim 13, wherein the one or more core plug samples include microbial biomass or a biofilm.

17. The method of claim 13, further comprising adjusting at least one parameter of the production well in response to an analysis of the one or more core plug samples.

18. A gas lift system for use in a production well, the gas lift system comprising:

a production tubing extending into the production well and including one or more side pocket mandrels at one or more depths; and one or more core plug holding apparatuses, each of the one or more core plug holding apparatuses comprising:

a tubular member configured to be inserted into a side pocket of a mandrel, the tubular member having an uphole end, a downhole end, and a core plug section located between the uphole end and the downhole end, wherein the core plug section is used for housing of one or more core plug samples and wherein tubular member includes one or more open orifices formed in the core plug section, wherein the core plug samples are used for one or more of microbiological sampling, geochemical sampling, corrosion sampling, and geological sampling, and wherein each of the one or more core plug holding apparatuses being installed in one or more of the side pocket mandrels.

19. The gas lift system according to claim 18, wherein the gas lift system includes a wireline-retrievable gas lift system.

* * * * *